US007042315B2

(12) United States Patent
Guguen et al.

(10) Patent No.: US 7,042,315 B2
(45) Date of Patent: May 9, 2006

(54) DEVICE FOR FILTERING ELECTROMAGNETIC WAVES

(75) Inventors: Charline Guguen, Rennes (FR); Gérard Haquet, Chateaubourg (FR)

(73) Assignee: Thomson Licensing, Boulogne-Billancourt (FR)

( * ) Notice: Subject to any disclaimer, the term of this patent is extended or adjusted under 35 U.S.C. 154(b) by 112 days.

(21) Appl. No.: 10/451,353

(22) PCT Filed: Nov. 14, 2001

(86) PCT No.: PCT/EP01/13166

§ 371 (c)(1),
(2), (4) Date: Dec. 11, 2003

(87) PCT Pub. No.: WO02/50939

PCT Pub. Date: Jun. 27, 2002

(65) Prior Publication Data

US 2004/0075512 A1 Apr. 22, 2004

(30) Foreign Application Priority Data

Dec. 21, 2000 (FR) ..... 00 16839

(51) Int. Cl.
*H01P 1/20* (2006.01)

(52) U.S. Cl. ..... 333/208; 333/135

(58) Field of Classification Search ..... 333/208, 333/135

See application file for complete search history.

(56) References Cited

U.S. PATENT DOCUMENTS 4,285,594 A * 8/1981 Butts et al. ..... 356/72
5,276,456 A 1/1994 Kim ..... 343/786

FOREIGN PATENT DOCUMENTS

EP 287671 10/1988
JP 11-201817 7/1999

OTHER PUBLICATIONS

Patent Abstracts of Japan, vol. 1999, No. 12, Oct. 29, 1999 & JP 11-201817.
Copy of search report dated Feb. 25, 2002.

* cited by examiner

*Primary Examiner*—Robert Pascal
*Assistant Examiner*—Kimberly Glenn
(74) *Attorney, Agent, or Firm*—Joseph J. Laks; Robert D. Shedd; Brian J. Cromarty

(57) ABSTRACT

The present invention relates to a device for filtering electromagnetic waves, consisting of a turret element comprising at least one pair of waveguide filters, each filter operating in a specific frequency band; the turret element being housed between a source antenna and an electromagnetic wave transmitter/receiver module.

8 Claims, 1 Drawing Sheet

DEVICE FOR FILTERING ELECTROMAGNETIC WAVES

This application claims the benefit, under 35 U.S.C. § 365 of International Application PCT/EP01/13166, filed Nov. 14, 2001, which was published in accordance with PCT Article 21(2) on Jun. 27, 2002 in English and which claims the benefit of French patent application No. 0016839, filed Dec. 21, 2000.

The present invention relates to a device for filtering electromagnetic waves, more particularly to a filtering device adapted to the wireless communication systems used in particular in the broadcasting of multimedia applications over the airwaves.

BACKGROUND OF THE INVENTION

With the arrival of digital making it possible to process ever bigger information throughputs, a problem of available frequency bandwidth for the broadcasting of multimedia applications over the airwaves is encountered. For a sufficient throughput, the trend is to rise in frequency towards the, as yet, free bands. Thus, new bidirectional radio systems have made their appearance in the millimetre bands. Known in particular is the MWS system (Multimedia Wireless System) which occupies 3 GHz of frequency band between 40.5 and 43.5 GHz. These fixed systems rely on a cellular deployment of the type used for mobile telephony (GSM). In order to avoid interference between cells, these systems use a pattern comprising an adequate number of cells, each cell of this pattern being differentiated from the others by its frequency band and also by the polarization used by the antennas. This allows maximum distancing between two subscribers using the same frequency and the same polarization and thus makes it possible to limit the risks of interference. Moreover, these systems being bidirectional, they can transmit in "full duplex" or simultaneous bidirectional mode. In this case, the subscriber side transmission or reception part must meet severe constraints regarding isolation between transmission and reception. Hence, an adequate frequency gap must be ensured between the up path and the down path in order to hone the implementation of the diplexer and limit the cost of the subscriber terminal. It is therefore necessary simultaneously to select two filters which will form the diplexer making it possible to isolate the transmission path and the reception path. The frequency gap being fixed by the constraints of implementation of the transmission/reception module, there are a number of transmission and reception filter pairs or RxTx filters allowing total coverage of the frequency plan required for deployment. To ensure correct deployment of a system of this type, it is therefore necessary to have several models of subscriber transmitter/receiver modules operating in several frequency bands. This multiplicity of configurations poses cost problems in the mass production of the subscriber terminal, this problem being all the more acute the bigger the frequency band to be shared.

One solution for avoiding having several versions of transmitter/receiver modules as a function of the desired frequency band consists in designing a transmitter/receiver module comprising all the filters covering the frequency plan, the choice of the filters being made by electronic switching with the aid of diodes. However, the use and the number of diodes required to implement the transmitter/receiver module tend to increase the cost of the terminal. Moreover, the switching circuits give rise to losses at millimetre frequencies and degrade the performance of the transmitter/receiver module. If one takes into account the fact that the selection of the frequency band and of the polarization of the signal will be done only once when installing the terminal at the subscriber's, the above solution appears to be much too complex and costly.

SUMMARY OF THE INVENTION

The aim of the present invention is therefore to propose a device for filtering electromagnetic waves which makes it possible to remedy the drawbacks mentioned above.

The subject of the present invention is therefore a device for filtering electromagnetic waves, characterized in that it consists of a turret element comprising at least one pair of waveguide filters, each filter operating in a specific frequency band.

According to one embodiment, the turret element is a cylindrical element rotatable about an axis furnished, parallel to the axis, with waveguides positioned on a cylinder centred on the axis. The waveguides are formed by cylindrical cavities which may be of circular, rectangular or square cross section. In this case, the pairs of filters are all available on one component exhibiting an axis of revolution and the selection of the diplexer is made by rotating this component which will contact the source antenna and the transmission/reception block of the transmitter/receiver device. By using this device, a single compact component comprising all the pairs of filters is produced. Once the selection has been performed by the installer, perfect continuity of the waveguides is ensured by clamping the assembly. The signals transmitted may be of like polarization or of cross polarization. The connecting of the filtering device to the source antenna is achieved either with the aid of a waveguide Tee or with the aid of an orthomode. Moreover, the filtering device is connected to the transmitter/receiver module by an element comprising two pieces of waveguide.

BRIEF DESCRIPTION OF THE DRAWINGS

Other characteristics and advantages of the present invention will become apparent on reading the description given hereinbelow of a preferred embodiment, this description being given with reference to the herein appended drawings in which.

DESCRIPTION OF PREFERRED EMBODIMENTS

By way of example, the present invention will be described while referring to an electromagnetic wave filtering device adapted so as to operate in the MWS system. As mentioned above, the MWS (Multimedia Wireless System) system occupies 3 GHz of frequency around the frequencies 40.5 GHz to 43.5 GHz. In the case of "full duplex" use, each operator will be allocated specific frequencies for the down and up paths. One of the frequency plans proposed offers three combinations while retaining the adequate Duplex gap, namely 1 GHz to 40 GHz. For each combination, the following are reserved:

300 MHz for the up channels,

700 MHz for the down channels.

Three possible combinations are represented in Table A

TABLE A

| Combination | 1 | 2 | 3 |
|---|---|---|---|
| Up path | 40.5–40.8 | 42.5–42.8 | 41.5–41.8 |
| Down path | 41.8–42.5 | 40.8–41.5 | 42.8–43.5 |

Moreover, in order to propose a richer pattern, transmission and reception are carried out under cross polarization in each cell. This enables the same transmission and reception frequencies to be reused in nearby cells.

Figure 1:
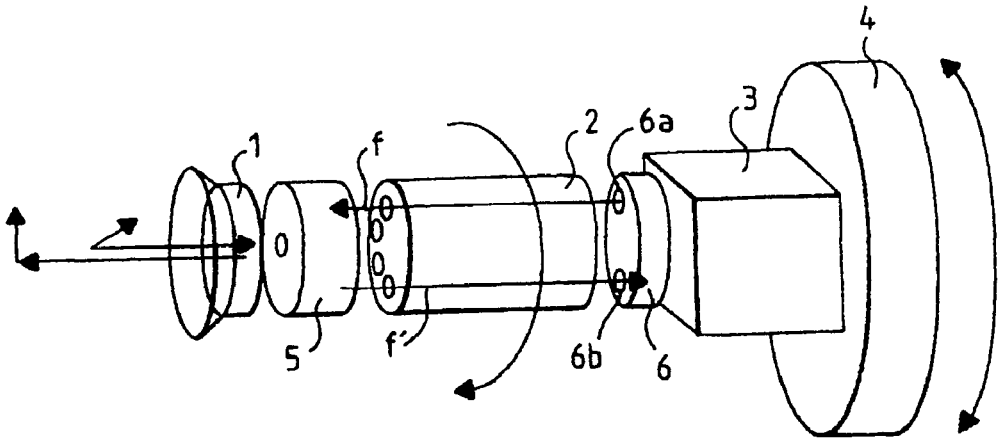
FIG. 1 is a perspective view of a device for receiving/transmitting electromagnetic waves in accordance with the present invention.

Represented in FIG. 1 is a filtering device allowing a single transmitter/receiver module to cover all the combinations of frequencies required for deployment. As represented in the figure, the device therefore comprises a source antenna 1 intended to receive or to transmit electromagnetic waves, a filtering device 2 consisting of a compact rotating component which will be described in greater detail hereinbelow, a transmitter/receiver module 3 consisting in a known manner of a transmission path and a reception path, this transmitter/receiver module being mounted on a support element 4 allowing a 90° rotation of the module so as to allow use under cross polarization. For example, reception is under horizontal polarization and transmission under vertical polarization and after 90° C. rotation of the assembly, reception is under vertical polarization and transmission under horizontal polarization. Moreover, to allow the connection of the above three elements, namely the source antenna 1, the filtering device 2 and the transmitter/receiver module 3, the device comprises a first connecting element 5 between the source antenna 1 and the filtering device 2, this connecting element 5 consisting of a waveguide Tee comprising a source antenna-side waveguide element and two filtering device-side waveguide pieces (not represented), as symbolized by the arrows f, f'. Likewise, a second connecting element 6 is provided between the transmitter/receiver module 3 and the filtering device 2. This connecting element 6 consists of a piece comprising two waveguides 6*a*, 6*b* positioned on one and the same diagonal. The waveguides of the Tee element or of the element 6 exhibit the same cross section as the filters of the turret device, namely a circular cross section in the embodiment represented.

Figure 2:
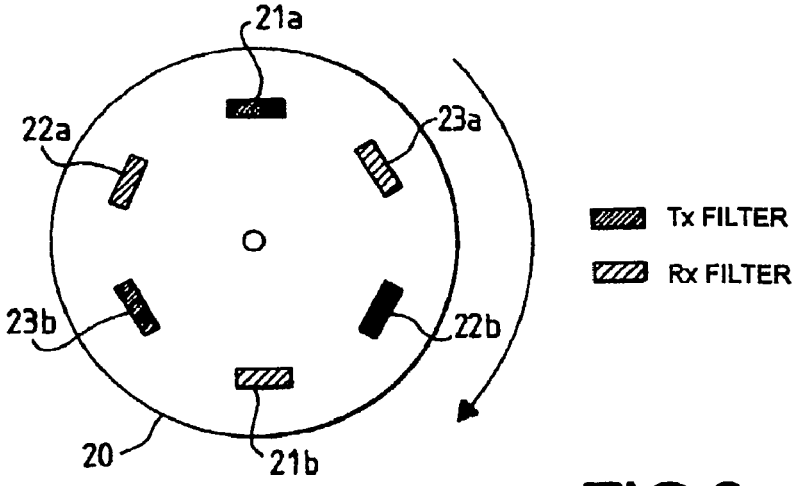
FIG. 2 is a sectional view showing the position of the filters in the turret element.

The filtering device 2 in accordance with the present invention will now be described in greater detail. This filtering device consists of a turret element comprising three pairs of waveguide filters in the embodiment represented, each filter operating in a specific frequency band. Thus, as represented in the figures, the turret element 2 consists of a solid cylindrical element made of brass, aluminium or the like and able to rotate about its axis 20, this element having a circular cross section in the embodiment represented. This solid cylindrical component is furnished parallel to its axis with 6 cylindrical cavities coupled in pairs, namely the cavities 21*a*–21*b*, 22*a*–22*b*, 23*a*–23*b* in FIG. 2. Each cylindrical cavity forms a waveguide which operates at a different frequency. The waveguide may be of circular cross section, as represented in FIG. 1 or of rectangular cross section, represented in as, or the sectional view of square cross section. As represented in the figures, the filters forming a pair 21*a*–21*b*, 22*a*–22*b*, 23*a*–23*b* are placed on one and the same diagonal. In the embodiment, each circular waveguide filter therefore consists of cavities coupled by irises which offer the same performance in both polarizations. A filter of this type is described for example in French Patent Application No. 00 13582 of 18 Oct. 2000 in the name of the applicant.

The device described above is used as follows. During the construction of the transmitter/receiver device, the installer selects the pair of transmission and reception filters which must be used by positioning them opposite the connecting means 6, as represented by the arrows f and f'. Next, the Tee is correctly positioned opposite the two selected filters and the assembly is clamped in such a way as to produce a single compact component.

Thus the present invention makes it possible to produce a "universal" transmitter/receiver device meeting the scheduling needs of a cellular radio system. Inside one and the same cell, all the transmitter/receiver devices are configured in the same way. Selection is done only when the terminal is put into service at the subscriber's. The use of a filter device as described hereinabove allows much reduced production and manufacturing costs.

The invention claimed is:

1. Device for filtering high frequency electromagnetic waves, consisting of a turret element rotatable about a main axis, said turret element comprising, in parallel to said axis, at least one pair of waveguide filters formed inside said turret element, each waveguide filter operating in a specific frequency band.

2. Device according to claim 1, wherein the turret element is a cylindrical element, the waveguide filters being positioned on a cylinder centred on the axis.

3. Device according to claim 1, wherein the waveguide filters are formed by cavities formed inside said turret element.

4. Device according to claim 3, wherein the cavity is of circular, rectangular or square cross section.

5. Device according to claim 3, wherein the cavity is furnished with coupling irises.

6. Device for receiving/transmitting electromagnetic waves comprising a source antenna, a filtering device for filtering high frequency electromagnetic waves comprising a turret element rotatable about a main axis, said turret element comprising, in parallel to said axis, at least one pair of waveguide filters formed inside said turret element, each waveguide filter operating in a specific frequency band, an electromagnetic wave transmitter/receiver module, and an element for connecting the source antenna to the selected pair of waveguide filters of the filtering device.

7. Device according to claim 6, characterized in that the connecting element consists of a Tee element or an orthomode.

8. Device according to claim 6, wherein the selected pair of waveguide of filters of the filtering device is connected to the transmitter/receiver module by an element comprising two pieces of waveguide elements.

* * * * *